US006357494B1

(12) United States Patent
Hahn et al.

(10) Patent No.: US 6,357,494 B1
(45) Date of Patent: Mar. 19, 2002

(54) CONTAINER CLOSURE

(76) Inventors: Hans-Ulrich Hahn, In der Wiek 20, DE 31535 Neustadt; Water Schulte, Am Rennert 16, DE 57413 Finnentrop, both of (DE)

( * ) Notice: Subject to any disclaimer, the term of this patent is extended or adjusted under 35 U.S.C. 154(b) by 0 days.

(21) Appl. No.: 09/403,413

(22) PCT Filed: Apr. 22, 1998

(86) PCT No.: PCT/EP98/02382

§ 371 Date: Dec. 23, 1999

§ 102(e) Date: Dec. 23, 1999

(87) PCT Pub. No.: WO98/49090

PCT Pub. Date: Nov. 5, 1998

(30) Foreign Application Priority Data

Apr. 25, 1997 (DE) ..... 197 17 619

(51) Int. Cl.[7] ..... B65B 1/04

(52) U.S. Cl. ..... 141/65; 141/67; 141/367; 141/378

(58) Field of Search ..... 141/65, 67, 367, 141/378, 349, 350, 348, 383, 384, 386

(56) References Cited

U.S. PATENT DOCUMENTS 4,699,298 A 10/1987 Grant
5,230,374 A * 7/1993 Dawson et al. ..... 141/231
5,435,413 A * 7/1995 Schoenborn ..... 141/65
5,597,021 A * 1/1997 Crossdale et al. ..... 141/346

FOREIGN PATENT DOCUMENTS

WO WO 92/00914 1/1992
WO WO 93/18920 9/1993

* cited by examiner

*Primary Examiner*—Steven O. Douglas
(74) *Attorney, Agent, or Firm*—Colleen Szuch

(57) ABSTRACT

A description is given of a container closure for filling and emptying containers, in particular drum-like transporting containers, which can be inserted in an exchangeable manner into a container opening, which receives a plug head. The container closure has a riser tube, which is connected to the plug head, and a removal connection element, it being the case that the latter can be locked to the plug head by means of a stud coding system which has coding studs and matching coding recesses. According to the invention, the coding studs are provided on a first securing part and the coding recesses are provided on a second securing part. One of the securing parts is designed as an annular disc, which can separately be fitted loosely, such that it cannot slip off, onto the modular removal connection element. The other of the securing parts is integrated in the plug head. The container closure described avoids mix-up of chemicals, permits simultaneous liquid removal and ventilation, and, while complying with the regulations for licensing hazardous substances, can be connected to commercially available containers or drums.

11 Claims, 3 Drawing Sheets

CONTAINER CLOSURE

FIELD OF INVENTION

The invention relates to a container closure for filling and emptying containers that can be inserted in an exchangeable manner into a container opening. The container closure consists of a plug head with a riser tube and a removal connection element that can be locked to the plug head by means of a stud coding system.

BACKGROUND OF THE INVENTION

Container closures of this type are known. U.S. Pat. No. 4,699,298 describes a connecting device for inserting tubes or pipes into the plug opening of a drum for the purpose of delivering liquid from the drum. In order to avoid contamination of the liquids which are to be delivered from the drum, the connecting device has a mechanical stud coding system which has protrusions and recesses, with the result that a certain removal element can only be connected to the plug body when the corresponding protrusions and recesses match one another in accordance with the coding system. A coupling ring which engages on the outside is used for the screwed connection of the removal element, in which a respective part of the stud coding system is firmly integrated, i.e. forms a unit with the removal element. For different substances, which require different stud coding systems in order to avoid the unintentional combination of systems which have already been used for different liquids, the corresponding removal elements thus have to be of completely different configurations. This renders such container closures relatively expensive, since they have to be produced more or less individually.

Furthermore, U.S. Pat. No. 3,913,608 discloses a container connection element which has a bayonet closure in order for it to be possible to remove a connection element quickly and easily from a connection stub of a container and fit it thereon. There is no provision for any additional means for securing against unintentional connection of an element which has already been used for a liquid other than that in the container.

German Patent 103116 discloses a drum closure which makes it possible for a drum to be filled or emptied under pressure without the assembly being tapped. Provided in the plug of the drum closure described is a valve arrangement, which can be opened and closed by there being screwed on a discharge connection stub which matches the plug and has pipe sockets by means of which the valves are opened or, upon removal of the same, closed again. A stud coding system for securing the connection of a specific connection stub for a specific plug is not described.

Furthermore, U.S. Pat. No. 3,905,522 describes a liquid-discharge device for use with a connection cock or a connection element for liquid containers. This device has a plug head which bears an angled siphon tube, which extends into the interior of a drum which is to be emptied, and on which a removal element, which is connected to corresponding liquid lines, may be connected on the outside of a drum by means of screw threads. The device does not have a stud coding system. The siphon tube extends, at an angle with respect to the centre axis of the device, from the plug body into the drum, it being the case that the end of the adjoining siphon-tube piece, which is angled back again, is guided back as far as the imaginary centre axis of the device. The angling of the siphon tube is intended to prevent the tube which remains in the drum from colliding with the drum-filling equipment or disrupting the filling operation.

The object of the invention is thus to provide a container closure which, so as to prevent mix-ups, can only be connected to defined containers, which is cost-effective to produce, whose riser tube is protected against buckling upon insertion into the container and minimizes abrasion of the inside of the container, which ensures simultaneous liquid removal and ventilation, and which is better suited, in particular, for chemicals.

SUMMARY OF THE INVENTION

The container closure according to the invention serves for filling and emptying containers. It can be inserted into a container opening, which can receive a plug head, so as to be exchangeable. The container closure has a riser tube, which is connected to the plug head, and a removal connection element, it being the case that, when the plug head has been fitted in the container opening, the riser tube, which is connected to the plug head, extends into the container usually as far as the base of the latter. The removal connection element can be locked to the plug head by means of a stud coding system, in a position which is predetermined by the stud coding system, and is connected in a sealing manner to the plug head by means of a coupling stopper. In a manner known per se, the stud coding system has coding studs and matching coding recesses. According to the invention, the coding studs are provided on a first securing part and the coding recesses are provided on a second securing part, it being the case that one of the securing parts is designed as an annular disc, which can separately be fitted loosely onto the modular removal connection element such that it cannot readily be removed again therefrom, i.e. such that it cannot slip off, and the other of the securing parts is integrated in the plug head.

This inventive container closure for the removal of liquid chemicals from, in particular, drum-like transporting containers serves to avoid contamination by external influences which have an adverse effect on the purity of special liquid chemicals, e.g. high-purity chemicals for manufacturing electronic components. Such a removal system according to the invention ensures that the high degrees of purity of the special liquid chemicals mentioned remain intact even during removal operations. This is because, as a result of the special stud coding system, which according to the invention is provided as a separate component for the modular removal connection element, on the one hand, for reasons of safety and contamination, the risk of chemicals being mixed up is ruled out and, on the other hand, in terms of construction and dimensions, the actual removal connection element is identical for a vast range of different chemicals, the only difference being that the actual stud coding system has to be designed specifically for the respective application case. This makes it possible for such removal systems, which ensure the removal of specific chemicals with minimized contamination, nevertheless to be produced cost-effectively.

According to a preferred exemplary embodiment of the invention, the annular disc is designed as a studded disc, i.e. the coding studs are provided thereon such that they engage in coding recesses which are provided in the plug head and are distributed on the circumference of the latter in accordance with the arrangement of the studs. This means that the first securing part is designed in the form of the annular disc and the second securing part is integrated in the plug head. Of course, it is also possible for the annular disc to be designed as a perforated disc and for the plug head to have corresponding studs which, in a locking position, match the recesses in the annular disc. Such a stud coding system thus rules out any risk of mix-up upon connection to chemical supply systems.

According to a further preferred exemplary embodiment, the riser tube, which is connected to the plug head and extends into the interior of the container, is provided with a folding-bellows section. The plug head, which bears the riser tube, has an external thread by means of which it can be screwed into the drum-like transporting container, which likewise has a matching thread. The riser tube, which may also be referred to as a submerged tube, may preferably be fitted onto a cylindrical, tubular socket which extends into the interior of the container. In order, on the one hand, to ensure reliable, complete emptying of the liquid from the container, the riser tube has to extend as far as the base, i.e. the lowermost point of the container. When the plug head is screwed into the opening of the container, the folding bellows ensures that the distance between the container base and the screwed-in plug head is covered as required. The folding bellows avoids the situation where riser tubes rupture under the action of pressure upon insertion of the plug head into the opening of the container. Furthermore, the folding bellows is preferably of such a flexibility that friction of the riser tube on the container base or on the container wall is minimized to the extent where no particles are abraded from the surface of the container base or of the riser tube. Consequently, the fitting of the riser tube in conjunction with the plug head, does not result in any contamination of the special high-purity chemicals located in the container.

According to a further preferred exemplary embodiment, the riser tube has an opening funnel, which is oriented in the direction of the base of the container. Provided on the end side of said funnel are circumferentially spaced-apart webs which leave an inflow cross-section when the opening funnel has been positioned on the container base, with the result that the container can be emptied virtually completely without having to be tilted or upended. Moreover, the opening funnel ensures uniform extraction of the chemicals located in the container.

Provided beneath the opening thread in the container opening, in the case of the conventional containers, is a shoulder which serves the purpose, in conjunction with an O-ring seal which is arranged on the plug head beneath the external thread and rests against a mating shoulder, of reliable sealing on the exterior of the plug head. An inner section of the plug head is provided with an internal thread in which the coupling stopper, which has an external thread and engages through the annular disc, can engage such that the removal connection element and the plug head can be reliably connected to one another in a sealing manner. The coupling stopper is arranged in a loosely displaceable manner on a cylindrical section of the removal connection element, and the annular disc is arranged displaceably and loosely on a cylindrical section above the externally threaded section of the coupling stopper, said externally threaded section engaging through the annular disc.

According to a further preferred exemplary embodiment of the invention, the coding studs are designed as cylinder studs and circular-ring-segment studs, which are in a mirror-inverted and congruent arrangement with respect to the correspondingly formed coding recesses arranged on the circumference of the plug head. The circular-ring-segment studs preferably also serve as arresting aids.

On its side which is directed towards the plug head, the removal connection element preferably has a flange which bears a first O-ring for sealing the removal connection element with respect to the plug head. Said O-ring is arranged on the flange such that in the braced state, i.e. in the state in which the coupling stopper has been screwed in a fixed and sealing manner into the sunken internally threaded section of the plug head, the connection element is connected to the plug head in a sealing manner.

According to a further preferred exemplary embodiment of the invention, the removal connection element, which in addition to removing the chemicals from the container also serves to ventilate the latter, is provided with a cylindrical tube section which projects into a cylindrical plug-head part which bears the riser tube. This cylindrical tube section of the removal connection element has a smaller diameter than the cylindrical part of the plug head and projects deeper into the cylindrical part of the plug head, when the removal connection element has been fitted, than a ventilation opening arranged in said cylindrical part. Said cylindrical tube section also has a sealing ring which, when the removal connection element has been fitted, is located beneath the ventilation opening in the cylindrical part of the plug head and has such an external diameter that, when the removal connection element has been inserted into the plug head, said seal, which is preferably likewise designed as an O-ring, effects a reliable sealing action in the interior of the cylindrical part. Said second O-ring is preferably borne in a groove of the cylindrical tube section and, inter alia, for the purpose of improving the sealing action when the removal connection element has been fitted and secured by means of the coupling stopper, is seated on a reduced-diameter section in the interior of the cylindrical part of the plug head, which is bounded by an annular shoulder beneath the ventilation opening. The second O-ring rests in a sealing manner in said section.

This creates a venting channel from the ventilation opening into the removal connection element. In order to route ventilation outwards, by way of the removal connection element, to a ventilation opening, the cylindrical section is extended into the removal connection element and, between its outer surface and the inner surface of the removal connection element, forms a space which leads into the ventilation connection line provided on said removal connection element. The container closure according to the present invention thus permits simultaneous liquid removal and ventilation.

According to yet another preferred exemplary embodiment, the plug head also has a threaded section which differs from the sunken internally threaded section for the coupling stopper and into which a threaded stopper can be screwed for the purpose of sealing the open plug head when the removal connection element has been removed. However, it is also possible, for the purpose of reliably closing off the plug head in a sealing manner, for the threaded stopper to be fitted into the sunken internally threaded section provided for the coupling stopper.

The container closure is preferably produced from inert plastic, i.e. a plastic which is not attacked by the chemicals with which the container closure comes into contact.

Other objectives, features and advantages of the present invention will become apparent from the following detailed description. The detailed description, while indicating specific embodiments of the invention, are provided by way of illustration only. Accordingly, the present invention also includes those various changes and modifications within the spirit and scope of the invention that may become apparent to those skilled in the art from this detailed description.

Further advantages, features and possible applications of the invention will now be explained in more detail with reference to an exemplary embodiment in conjunction with the attached drawings, in which:

DETAILED DESCRIPTION OF THE INVENTION

Figure 1:
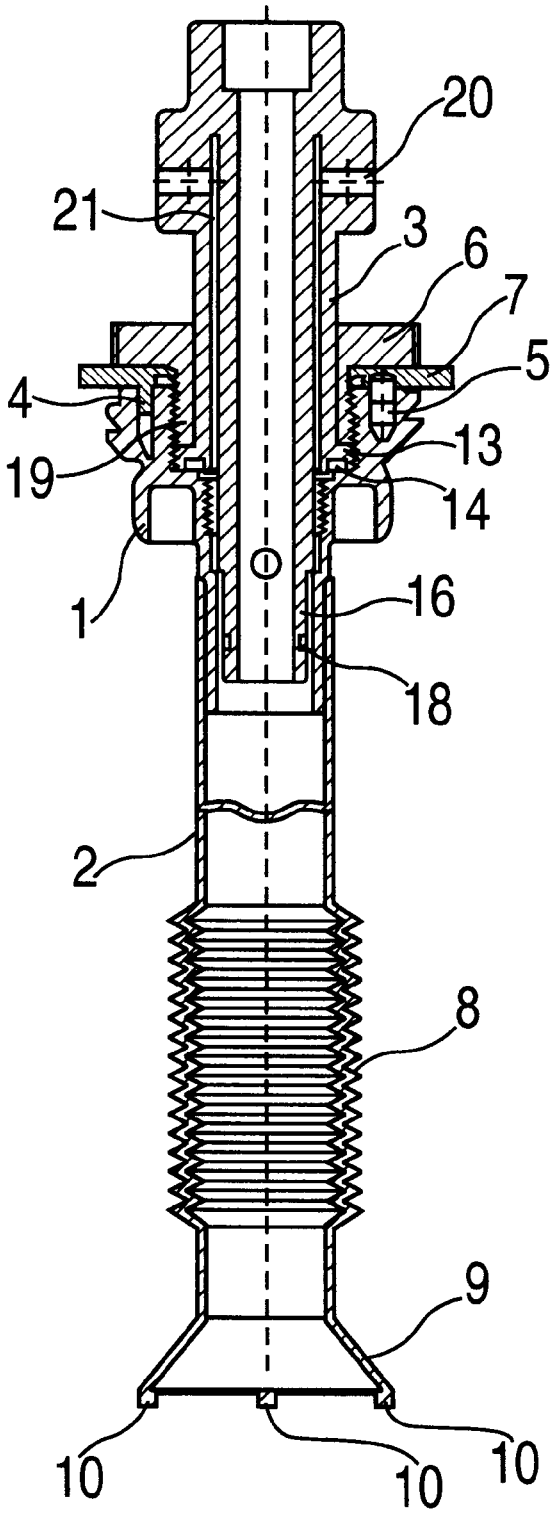
FIG. 1 shows a fitted container closure according to the invention.

FIG. 1 shows the container closure according to the invention in the fitted state. For the sake of simplicity, the container has been left out. In the fitted state, the container closure is in its removal state. A plug head 1, which is seated in a container opening, is provided with coding recesses 5.

These coding recesses 5 are made as cylindrical recesses 5' and circle-segment-shaped recesses 5" at defined, i.e. coded, intervals on the circumference of the outwardly oriented end surface of the plug head 1.

Figure 3:
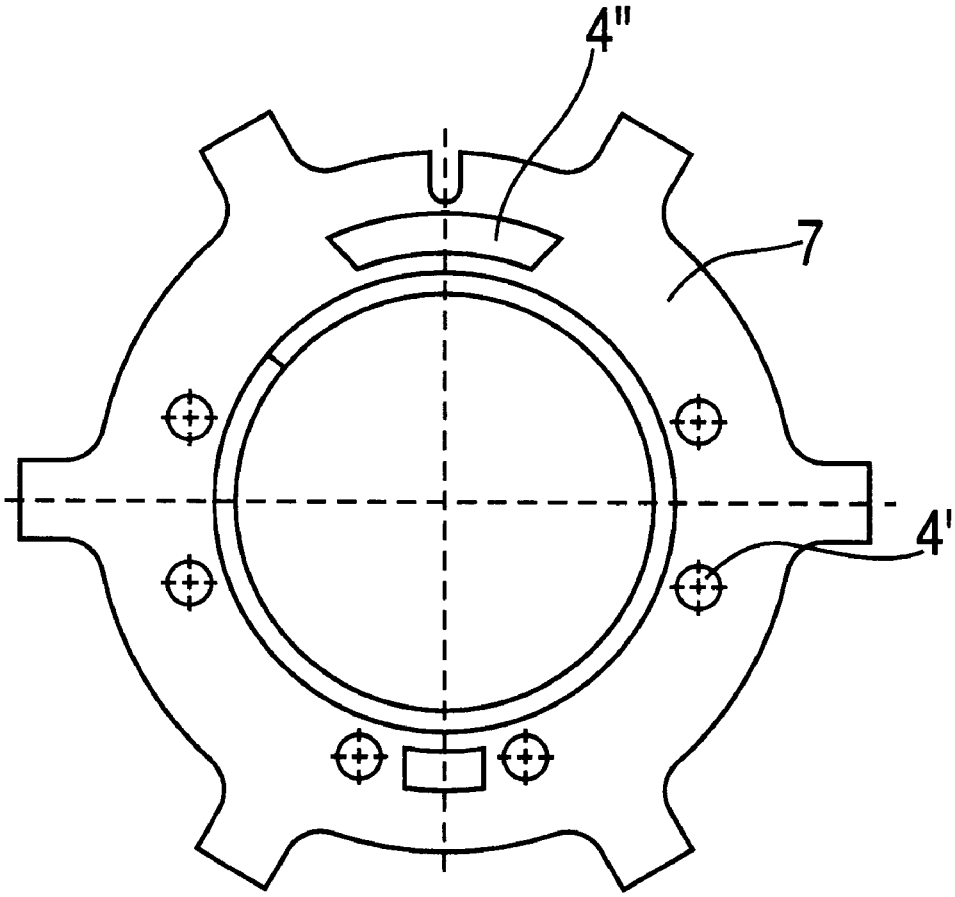
FIG. 3 shows the plan view of a studded disc according to the invention.
Figure 4:
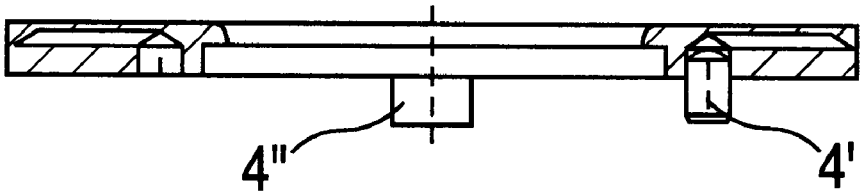
FIG. 4 shows a lateral sectional view of the studded disc according to FIG. 3.

The removal connection element 3 has a cylindrical section, on which a coupling stopper 6 is arranged in a displaceable manner. This coupling stopper 6 has a threaded section 11, which matches the internally threaded section 12 which is sunken in the plug head 1, with the result that, for the purpose of fastening the removal connection element 3 in the plug head 1, the coupling stopper 6 can be screwed into the sunken internally threaded section 12. The head of the coupling stopper 6 is of flange-like design and supports an annular disc 7 with the inner end surface of a flange. The annular disc 7 is arranged loosely and displaceably on a thread-free section of the coupling stopper 6, the threaded section 11 engaging centrally through the annular disc 7. The annular disc 7 has coding studs 4, with the result that the annular disc 7 is designed as a studded disc. The coding studs 4 of the studded disc are arranged such that they are in a mirror-inverted and congruent arrangement on that surface of the annular disc 7 which is directed towards the outwardly oriented end surface of the plug head 1, and match the coding recesses 5. Accordingly, the coding studs 4 are designed as cylindrical studs 4' and circular-ring-segment studs 4" (FIGS. 3 and 4).

The coupling stopper 6, which bears the studded disc, is secured on the cylindrical part of the removal connection element 3 such that it cannot slip off, with the result that, once it has been fitted on said cylindrical part of the removal connection element 3, which is otherwise of identical design for different chemicals, said coupling stopper cannot readily be removed therefrom.

If the removal connection element 3 is to be connected to the plug head 1, in which case, in accordance with the stud coding system, only a coded arrangement of cylindrical and circular-ring-segment studs matches the correspondingly formed recesses, then the first step is for the removal connection element to be fitted, by way of its cylindrical tube section 16, into the plug head 1, as far as the region of the cylindrical part 15 of said plug head 1. Thereafter, the studded disc 7 is rotated such that its coding studs 4 match the corresponding coding recesses 5 and these studs are inserted into these coding recesses until the studded disc 7 rests on the outer end surface of the plug head 1. After this, the coupling stopper 6, which engages through the central region of the studded disc 7 by way of its threaded section 11, is screwed into the sunken internally threaded section 12 of the plug head 1 until the removal connection element 3 is fixedly connected to the plug head 1. In order to prevent the coupling stopper 6 with the studded disc 7 from being removed from the cylindrical part of the removal connection element, the latter has a stop flange 13 at the end of the cylindrical section. Provided on the end side of said stop flange 13 is a first O-ring 14, which is arranged in a groove and, in the fitted state, provides for sealing of the removal connection element 3 in the plug head 1. In this case, said first O-ring 14 rests on a shoulder which is arranged in the interior of the plug head 1 at the end of the sunken internally threaded section 12.

The plug head 1 has a cylindrical part 15 which is oriented in the direction of the container interior. A ventilation opening 17 is provided in said cylindrical part. The internal diameter of said cylindrical part 15 of the plug head 1 is greater than the external diameter of the cylindrical tube section 16 of the removal connection element 3, there being arranged beneath the ventilation opening 17 an annular shoulder 19, from which the internal diameter of the cylindrical part 15 of the plug head 1 decreases. Even this reduced-diameter section beneath the annular shoulder 19 in the cylindrical part 15 of the plug head 1 is greater, in terms of its internal diameter, than the external diameter of the cylindrical tube section 16 of the removal connection element 3. Provided at one point of the cylindrical tube section 16 of the removal connection element 3, which, in the fitted state of the removal connection element 3, is located in the cylindrical part 15 of the plug head 1 beneath the ventilation opening 17, is a second O-ring 18, which is provided in a groove and seals a space, for ventilation and venting purposes, in the downward direction into the riser tube 2, said space being provided between the inner surface of the cylindrical part 15 of the plug head and the outer surface of the cylindrical tube section 16 of the removal connection element 3.

Said cylindrical tube section 16 of the removal connection element 3 is routed upwards, far into the interior of the removal connection element 3, in the form of a cylindrical annular gap according to FIG. 1, to be precise into a region of the removal connection element 3 which is thickened and at which venting valves or lines, via which the corresponding ventilation takes place, can be screwed into a connection stub 20.

A riser tube 2 is pushed rigidly onto the cylindrical part 15 of the plug head 1, said cylindrical part extending into the container, with the result that the riser tube is retained by said cylindrical part 15. Arranged at the bottom end of the riser tube 2 is an opening funnel 9 which, when the plug head 1 has been inserted, is seated on the container base. On its end surface which is directed towards the container base, the opening funnel has circumferentially spaced-apart webs 10 which ensure that a sufficient flow cross-section is provided between the container base and the webs 10 when the opening funnel 9 of the riser tube 2 has been seated on the container base. The webs 10 further ensure that, when the plug head 1 is screwed into the container opening, as little material of the opening funnel 9 as possible comes into frictional contact with the container base or with the container wall, with the result that the quantity of possibly abraded particles is minimized or avoided completely.

A section which is designed as a folding bellows 8 is located in the region between the top part of the riser tube 2, said top part being seated on the cylindrical part of the plug head 1, and the opening funnel 9 of said riser tube. This folding bellows 8 can compensate for several centimetres in the longitudinal direction in order to cover different distances between a base or a wall of a container and the plug head 1, which is located opposite and has been screwed into a container opening. This also makes it possible to use one and the same container closure for different container dimensions and types of container. Furthermore, the folding bellows 8 serves for compensating for any slopes in the container base or the container wall on which the opening funnel 9 is seated, without there being any possibility of the riser tube 2 buckling when the plug head 1 is inserted into the opening of the container.

Figure 2:
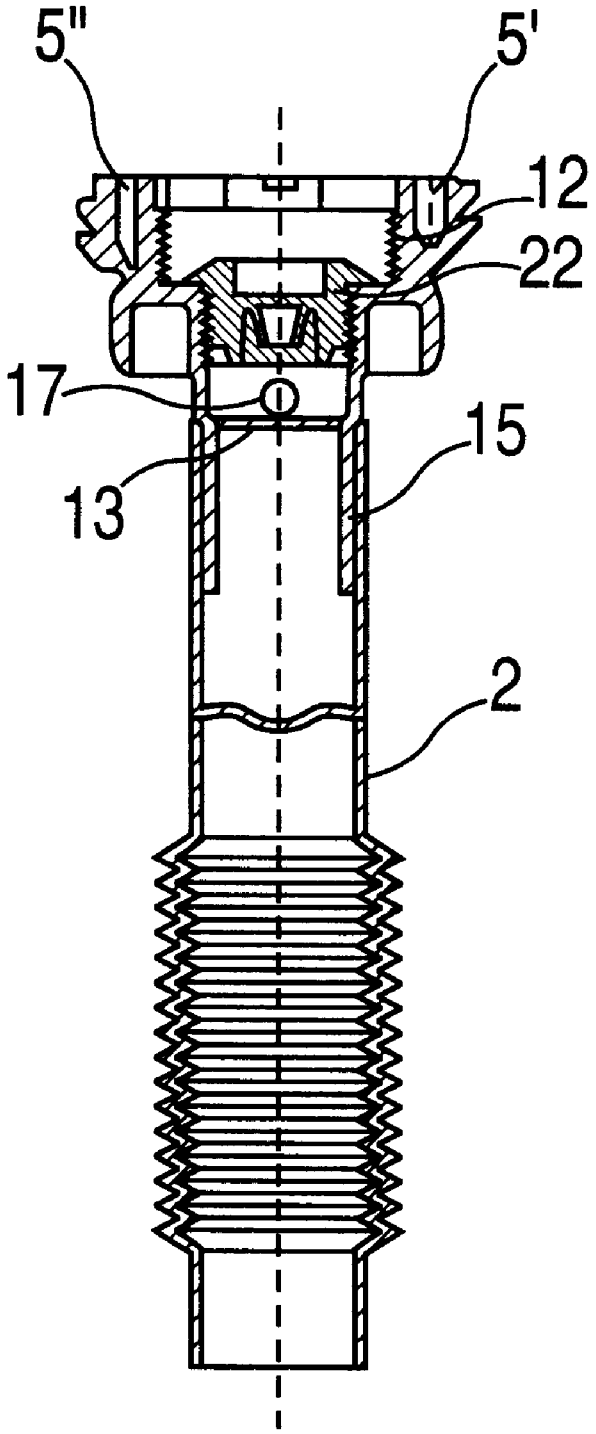
FIG. 2 shows a plug head with riser tube and threaded stopper, the removal connection element according to the invention having been removed.

FIG. 2 illustrates a plug head 1, which bears the riser tube 2, it being the case, in this illustration, that the removal connection element 3 has not been inserted. Rather, a threaded stopper 22 has been inserted into the plug head 1 in its place. The threaded stopper 22 can be screwed in a sealing manner into a threaded section of the plug head 1 which is offset inwards in relation to the sunken internally threaded section 12, which receives the coupling stopper 6. The containers either may be provided with a conventional closure or may have already been equipped with such a plug head which, in the delivery state, bears the threaded stopper 22 for closure purposes. This ensures that just one coding stud arrangement, which matches the spacings and forms predetermined by the coding recesses 5 in the plug head 1, and thus a specific removal connection element 3, fits. Consequently, the predetermined stud coding system rules out any mix-up of chemicals.

The point on the cylindrical part 15 at which the ventilation opening 17 is arranged can also be seen from FIG. 2. Arranged beneath the ventilation opening 17 is the annular shoulder 19, from the bottom of which, in the direction of the riser tube 2, the reduced-diameter section of the cylindrical part 15 of the plug head 1 is provided.

The annular disc 7, which is designed as a studded disc, is illustrated in FIG. 3. Cylindrical studs 4' and circular-ring-segment studs 4" are spaced apart circumferentially on that end side of the annular disc which, in the fitted state, is directed towards the coding recesses 5 in the plug head 1. A variation in spacings and in the form of the studs, which may also be of, for example, rectangular or triangular cross-section, can provide any number of stud coding systems, which ensures that it is only possible for the coding stud arrangements and forms which match predetermined recesses 5 in the plug head 1 to be used and thus the associated removal connection element to be connected.

In order that, when the removal connection element 3 is fitted in the plug head 1, the correct positioning of the studded disc 7 in relation to the recesses located in the plug head 1 can be identified and implemented quickly, the studded disc 7 has a marking slit arranged on the circumference. The outwardly projecting, tooth-like extensions serve for bringing the studded disc into the necessary coding position.

FIG. 4 illustrates a lateral sectional view of the studded disc according to FIG. 3. In this illustration, a cylindrical coding stud 4' and a circular-ring-segment coding stud 4" have been inserted into the disc or provided thereon. Said coding studs may either be attached using conventional, known adhesive-bonding methods or be inserted into appropriately prepared openings and likewise fastened to the studded disc by adhesive bonding.

The container closure according to the invention, in conjunction with the stud coding system, thus rules out any mix-up of chemicals and, consequently, any contamination of high-purity chemicals. Furthermore, the container closure according to the invention permits simultaneous liquid removal and ventilation of the container, in order that the liquid can be removed without difficulty. Moreover, the container closure according to the invention is constructed such that the coupling stopper described means that liquid lines and ventilation lines do not have to be separated when the removal connection element is connected to the plug head or removed therefrom. Since the plug head is adapted to commercially available drum threads, in particular, it is also possible for the container closure according to the invention to be used in commercially available containers, in particular drums. Furthermore, the design according to the invention means that the container closure according to the invention satisfies the requirements for the existing licensing of hazardous substances. The inventive configuration of the container closure in conjunction with the riser tube ensures a high throughflow rate, of at least 20 1/min, of liquid which is to be removed from the container.

What is claimed is:

1. A container closure which receives a plug head (1) and connected thereto a riser tube (2), and a removal connection element (3) that locks into plug head (1) via a stud coding system (4,5), the stud coding system consisting of:

(a) coding studs (4) comprising cylinder studs (4') and circular-ring-segment studs (4"), and (b) coding recesses (5), comprising cylinder recesses (5'), shaped to corresponded to cylinder studs (4'), and circular-ring-segment recesses (5"), shaped to correspond to circular-ring-segment studs (4"), wherein coding recesses (5', 5") are arranged on the circumference of plug head (1) and studs (4) are placed in a mirror-inverted arrangement with respect to the correspondingly formed recesses (5).

2. The container closure of claim 1, wherein said coding studs (4) are provided on a first securing part (4,7) and said coding recesses (5) are provided on a second securing part(1, 5).

3. The container closure of claim 2, wherein one of said securing parts is designed as an annular disc (7).

4. The container closure of claim 3, wherein said securing part is fitted loosely onto said removal connection element (3) such that it cannot slip off.

5. The container closure of claim 2, wherein the other securing part is integrated in said plug head (1).

6. A container closure which receives a plug head (1) and connected thereto a riser tube (2), and a removal connection element (3), said removal connection element (3) containing additionally a cylindrical tube section (16) that projects into a cylindrical part (15) of plug head (1) with sufficient depth upon assembly to effect sealing between ventilation opening (17) and cylindrical part (15) with seal (18).

7. The container closure of claim 6, wherein said seal (18) has a second O-ring which is borne in a groove of said cylindrical tube section (16).

8. The container closure of claim 7, wherein said cylindrical tube section (16) is extended into said removal connection element (3) and forms a space (21) between the outer surface and the inner surface of the removal connection element (3), which leads to a ventilation connection line (20) provided on said removal connection element.

9. The container closure of claim 7, wherein said O-ring rests in a sealing manner in a reduced-diameter region of the cylindrical part (15) of the plug head (7) when said removal connection element (3) has been fitted.

10. A container closure which receives a plug head (1) and connected thereto a riser tube (2), and a removal connection element (3), wherein riser tube (2) has an opening funnel (9), the end side of said opening funnel (9) being provided with spaced-apart webs (10).

11. The container closure of claim 10, wherein said webs (10) leave an inflow cross-section when the opening funnel (9) has been positioned on a container base.

* * * * *